US005585756A

United States Patent [19]

Wang

[11] Patent Number: 5,585,756

[45] Date of Patent: Dec. 17, 1996

[54] GATED INTEGRATOR WITH SIGNAL BASELINE SUBTRACTION

[75] Inventor: Xucheng Wang, Lisle, Ill.

[73] Assignee: University of Chicago, Chicago, Ill.

[21] Appl. No.: 394,958

[22] Filed: Feb. 27, 1995

[51] Int. Cl.[6] ..... G06G 7/64

[52] U.S. Cl. ..... 327/341; 327/307; 327/336; 327/337; 330/9; 330/11

[58] Field of Search ..... 327/336, 337, 327/341, 344, 345, 307, 384, 385; 330/9, 11

[56] References Cited

U.S. PATENT DOCUMENTS

| | | | |
|---|---|---|---|
| 3,818,357 | 6/1974 | Crockett et al. | 327/335 |
| 3,953,805 | 4/1976 | Couvillon | 327/307 |
| 4,119,960 | 10/1978 | Hill | 327/307 |
| 4,211,981 | 7/1980 | Lerma | 327/341 |
| 4,237,424 | 12/1980 | Weiner | 330/11 |
| 4,257,006 | 3/1981 | Schaumann | 327/336 |
| 4,365,204 | 12/1982 | Haque | 327/337 |
| 4,393,351 | 7/1983 | Gregorian et al. | 327/337 |
| 4,438,354 | 3/1984 | Haque et al. | 327/337 |
| 4,651,032 | 3/1987 | Nobuta | 327/341 |
| 4,800,586 | 1/1989 | Meier | 379/399 |
| 4,814,714 | 3/1989 | Beadle | 327/339 |
| 5,175,748 | 12/1992 | Takahashi | 375/316 |

OTHER PUBLICATIONS

Nowicka,"Differential Amp Cancels Integrator's Crosstalk" Electronics Dec. 18, 1980.

"Model SR250 Fast Gated Integrators and Boxcar Averager", Stanford Research Systems, Product Data Sheet.

"Gated Integrator Module", Evans Electronics, 1991.

"Bunch Signal Processor", Bergoz.

*Primary Examiner*—Timothy P. Callahan
*Assistant Examiner*—Kenneth B. Wells
*Attorney, Agent, or Firm*—Reinhart, Boerner, Van Deuren, Norris & Rieselbach, s.c.

[57] ABSTRACT

An ultrafast, high precision gated integrator includes an opamp having differential inputs. A signal to be integrated is applied to one of the differential inputs through a first input network, and a signal indicative of the DC offset component of the signal to be integrated is applied to the other of the differential inputs through a second input network. A pair of electronic switches in the first and second input networks define an integrating period when they are closed. The first and second input networks are substantially symmetrically constructed of matched components so that error components introduced by the electronic switches appear symmetrically in both input circuits and, hence, are nullified by the common mode rejection of the integrating opamp. The signal indicative of the DC offset component is provided by a sample and hold circuit actuated as the integrating period begins. The symmetrical configuration of the integrating circuit improves accuracy and speed by balancing out common mode errors, by permitting the use of high speed switching elements and high speed opamps and by permitting the use of a small integrating time constant. The sample and hold circuit substantially eliminates the error caused by the input signal baseline offset during a single integrating window.

17 Claims, 2 Drawing Sheets

GATED INTEGRATOR WITH SIGNAL BASELINE SUBTRACTION

CONTRACTUAL ORIGIN OF THE INVENTION

The United States Government has rights in this invention pursuant to Contract No. W-31-109-ENG-38, between the U.S. Department of Energy and The University of Chicago, representing Argonne National Laboratory.

BACKGROUND OF THE INVENTION

This invention relates generally to integrator circuits and, more particularly, to gated integrator circuits capable of high precision, ultrafast operation.

Although practical integrator circuits are simple in concept and straightforward in theoretical operation, various practical problems arise when actual circuits are built and operated. Frequently, the signal to be integrated includes a DC component or baseline offset that, if not subtracted or otherwise compensated for, distorts the final result. In addition, electronic switches do not simply open and close perfectly but, rather, inject spurious charges of their own that can adversely affect integrating accuracy. Active components, such as op amps, introduce inaccuracies of their own. Passive components, such as resistors and capacitors, are non-ideal and can introduce further inaccuracy.

Depending on the application, it is often possible to compensate for particular sources of inaccuracy and obtain reasonable performance over a limited range. However, accuracy is typically obtained at the expense of high speed operation and vice-versa. Generally, accurate circuits tend to be slow, and fast circuits tend to be inaccurate.

In the past, compensation networks were added to each electronic switch to reduce switch charge injection errors. Although effective, this approach was problematic in that it was extremely difficult to trim all the networks' components to obtain accurate compensation, particularly when large quantities of integrators were produced. Similarly, voltage-to-current converters (i.e., current pumps) were placed in front of the electronic gate switches to minimize the error introduced by the "on" resistance of the switches. These current pumps became unstable and temperature dependent, however, when they were used with high speed op amps. Signal baseline error has been corrected in the past by first integrating the total input signal during a first integrating period or window and then integrating the signal baseline offset over a second integrating period or window. The two integrated signals were then subtracted to yield the final result. Although effective in theory, practical circuits employing such an approach were very complicated. As a result, it was difficult to match the characteristics of the two gated integrators and compensate for other errors such as charge injection errors. Again, although some success has been achieved in improving integrator circuit operation under some conditions, accuracy has not heretofore been obtained in combination with extreme circuit speed and reasonable circuit simplicity and economy.

SUMMARY OF THE INVENTION

The invention provides a gated integrator including an input buffer amplifier having an input for receiving a signal to be integrated and having an output at which the signal to be integrated appears. The gated integrator further includes a DC offset detector coupled to the output of the input buffer amplifier and operable to develop a signal equal to the DC component of the signal appearing at the output of the input buffer amplifier. The gated integrator further includes an op amp having a pair of differential inputs and an output, a first switched input network coupling the output of the input buffer amplifier to one of the differential inputs, and a second switched input network coupling the output of the DC offset detector to the other of the differential inputs. The gated integrator further includes an integrating capacitor connected between the output of the op amp and one of the differential inputs and an additional capacitor connected between the other of the differential inputs and circuit ground.

The invention also provides a method of configuring a gated integrator to enhance integrating speed and minimize error. The method includes the steps of providing an op amp having two differential inputs and coupling an input network to each of the differential inputs, wherein each of the input networks is of substantially similar electrical configuration and characteristics so that electronic errors introduced by each of the input networks occur substantially simultaneously and substantially identically in each of the input networks. The method further comprises the steps of applying a signal to be integrated to one of the differential inputs of the op amp through one of the input networks and applying a signal substantially equal to the DC offset of the signal to be integrated to the other of the differential inputs through the other of the input network. This balances the DC offset of the signal to be integrated and thereby renders the integrator insensitive to the DC offset of the signal to be integrated.

In one embodiment, the first switched input network and second switched input network are substantially similar in construction and in their electrical characteristics.

In one embodiment, the first and second input networks each includes a series connected resistor and electronic switch.

In one embodiment, the resistors of the first and second input networks and the electronic switches of the first and second input networks are matched components.

It is an object of the present invention to provide a new and improved ultrafast, resetable gated integrator with extremely low output offset error and droop.

It is a further object of the present invention to provide an ultrafast gated integrator that provides a well-defined mathematical relationship between the input and output signals.

It is a further object of the present invention to provide an ultrafast gated integrator that cancels the "on" resistance of the gate switches to make possible a small integrating time constant and thereby provide accurate high speed operation.

It is a further object of the present invention to provide a gated integrator that provides extreme precision in combination with high speed operation.

It is a further object of the present invention to provide a gated integrator that compensates for signal baseline errors during one timing window rather than two.

It is a further object of the present invention to provide a gated integrator that provides accuracy and speed utilizing uncomplicated circuitry that is easy and economical to build, adjust and operate.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
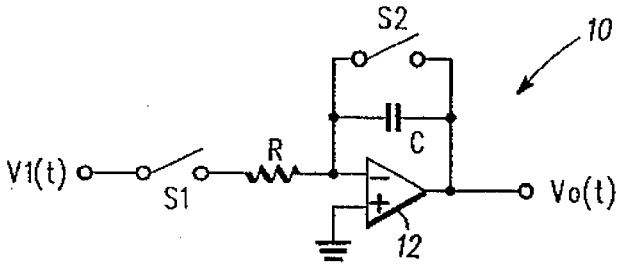
PRIOR ART Fig. 1
FIG. 1 is a simplified schematic diagram of a conventional, prior art gated integrator circuit.

A conventional prior art gated integrator 10 is shown in FIG. 1. The integrator 10 is based around an operational amplifier or op amp 12 having a pair of differential, non-inverting and inverting inputs and an output. The signal to be integrated $V_{i(t)}$ is applied to the inverting input of the op amp 12 through a switch $S_1$ and a resistor R. An integrating capacitor C is connected between the output of the op amp 12 and the inverting input. A reset switch $S_2$ is connected across the integrating capacitor C. The non-inverting input of the op amp 12 is connected to circuit ground. The output $V_{o(t)}$ of the integrator appears at the output of the op amp 12.

Figure 2:
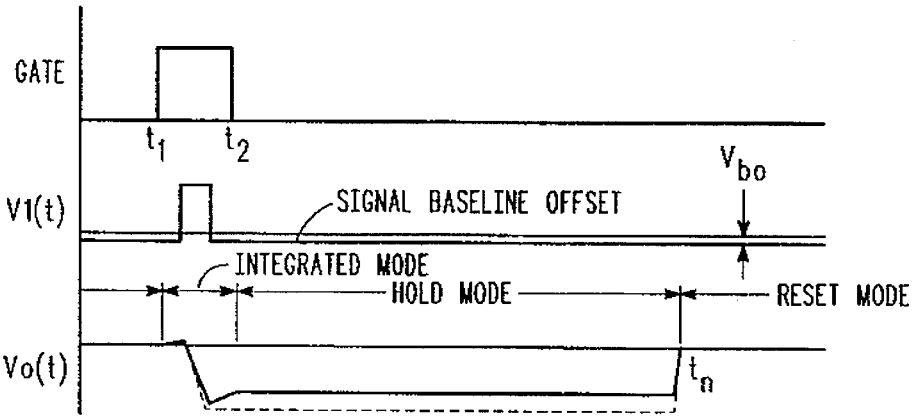
FIG. 2 is a voltage waveform diagram of an ideal gated integrator useful in understanding the operation of, and the terminology associated with, gated integrators.

In operation, the reset switch 52 is initially closed to discharge the integrating capacitor C. The gating switch $S_1$ is initially open. The circuit 10 is placed in an integrating mode when the reset switch $S_2$ opens and the gate switch $S_1$ closes. The integrating mode ends when the gate switch $S_1$ opens. During the period that the gate switch $S_1$ is closed (the "integrating window") the output voltage $V_{o(t)}$ varies in accordance with the integral of the input signal $V_{i(t)}$. At the end of the integrating mode, $V_{o(t)}$ holds constant at the final integrated value until the reset switch $S_2$ closes to reset the circuit 10. These concepts are illustrated graphically in FIG. 2. The gate waveform between times $t_1$ and $t_2$ depict the time that the gate switch $S_1$ is closed to establish the integrating window. As further illustrated in FIG. 2, the signal to be integrated $V_{i(t)}$ includes, in addition to a waveform of interest, a signal baseline offset that comprises a positive or negative DC component superimposed on the signal of interest. The magnitude of the signal baseline offset in the illustrated figure is designated by the quantity $V_{bo}$. In the absence of signal baseline offset, the integrator output voltage $V_{o(t)}$ would have the waveform shown by the broken line in FIG. 2. However, when the signal baseline offset is non-zero, the output voltage waveform is like that shown by the solid line. Because the signal baseline offset is typically a result of circuit artifacts rather than a real component of the input signal $V_{i(t)}$, the difference between the solid and broken lines in the output voltage waveform of FIG. 2 constitutes an error and source of inaccuracy.

The basic circuit 10 of FIG. 1 is reasonably accurate for slow speed applications provided that the input baseline offset $V_{bo}$ is very low. The problems of error output become more severe in a high speed gated integrator because of the small integrator time constant and the limitations of non ideal components. The desired output is often buried in the error output.

Figure 3:
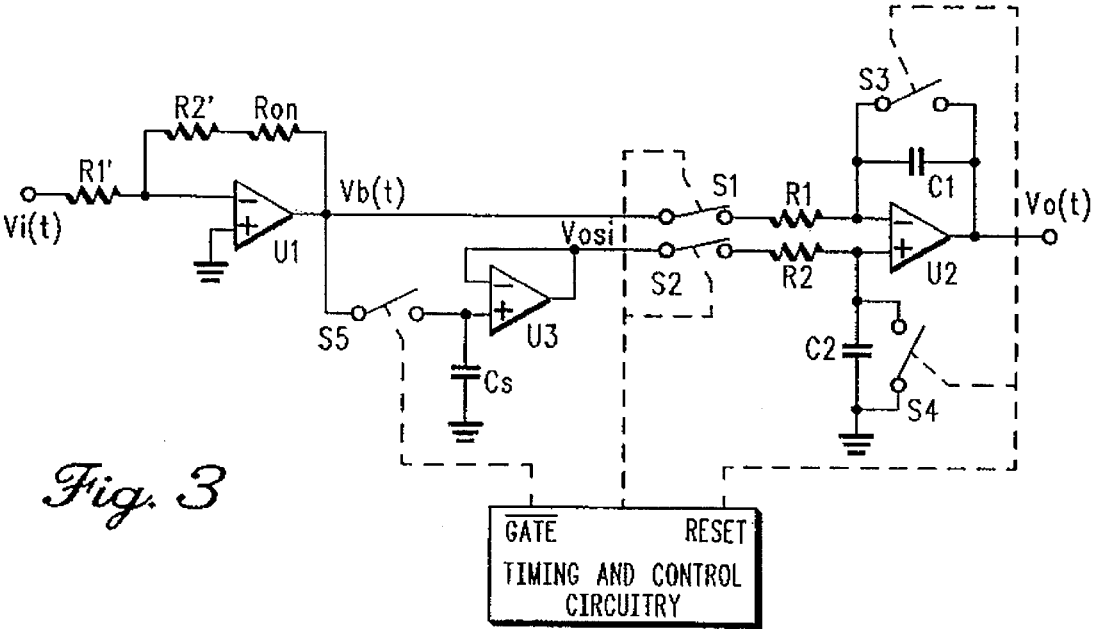
FIG. 3 is a simplified schematic diagram of an ultrafast, high precision gated integrator embodying various features of the invention.
Figure 4:
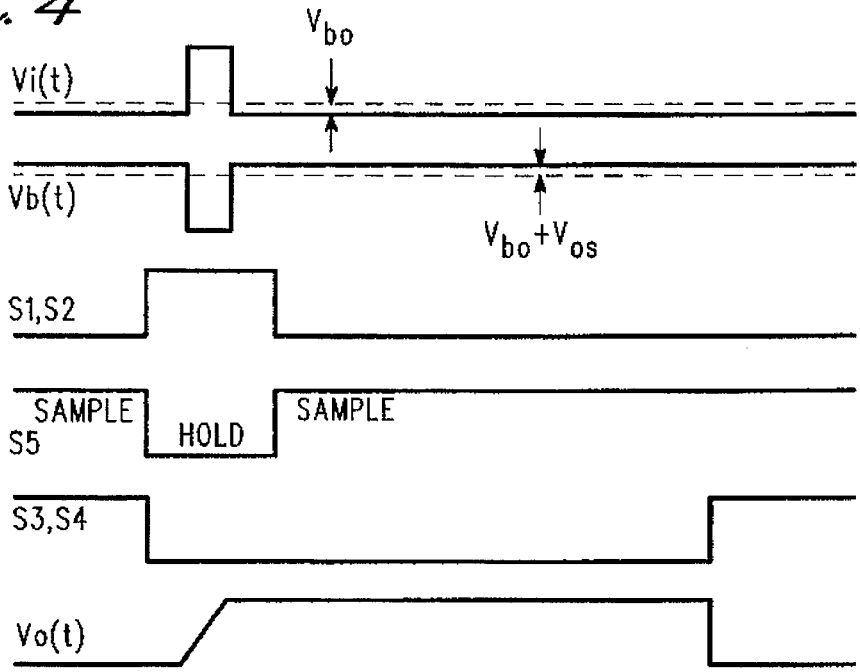
FIG. 4 is a timing diagram useful in understanding the operation of the gated integrator shown in FIG. 3.

An ultrafast, high precision gated integrator 20 embodying various features of the invention is illustrated in simplified schematic form in FIG. 3. As illustrated, the integrator 20 exhibits totally symmetrical architecture with separate AC and DC input signal paths. The circuit 20 consists of an input buffer amplifier 22 centered around a first op amp $U_1$, a gated integrator 24 centered around a second op amp $U_2$ and a DC offset detector 26 centered around a third op amp $U_3$. Each of the op amps $U_1$, $U_2$ and $U_3$ includes an inverting input and a noninverting input and further includes an output. A first integrating capacitor $C_1$ is connected between the output and inverting input of the second op amp $U_2$ and a second integrating capacitor $C_2$ is connected between the non-inverting input of the second op amp $U_2$ and circuit ground. A first reset switch $S_3$ is connected across the first integrating capacitor $C_1$ and a second reset switch $S_4$ is connected across the second integrating capacitor $C_2$. A pair of input gate switches $S_1$ and $S_2$ are coupled, respectively, to the inverting and non-inverting inputs of the second op amp $U_2$ through respective series resistors $R_1$ and $R_2$. When the reset switches $S_3$ and $S_4$ are closed, the second op amp $U_2$ is held in a reset mode and the output voltage $V_{o(t)}$ is held at zero (FIG. 4). When the reset switches $S_3$ and $S_4$ are opened and the input gates switches $S_1$ and $S_2$ are closed, the second op amp $U_2$ is placed in an integrating mode.

Preferably, the input gate switches $S_1$ and $S_2$ are matched components as are the series input resistors $R_1$ and $R_2$. Similarly, the integrating capacitors $C_1$ and $C_2$ are matched components as are the reset switches $S_3$ and $S_4$. In this manner, the switched input networks associated with both the inverting and noninverting inputs of the second op amp $U_2$ are substantially matched in terms of configuration and electrical characteristics. As a result, inaccuracies and/or spurious signal components generated by the switches $S_1$–$S_4$, input resistors $R_1$, $R_2$ or integrated capacitors $C_1$, $C_2$ occur substantially identically in each input channel and are effectively canceled by the common mode rejection of the op amp $U_2$. Preferably, the input gate switches $S_1$ and $S_2$ and the reset switches $S_3$ and $S_4$ comprise electronic switches such as MOSFETs. It will be appreciated, however, that other forms of analog switches, such as diodes, and FET switches, can also be used. The charge injection errors introduced by the dynamic switching transitions of such devices are substantially canceled by reason of the symmetrical circuit architecture and the common mode rejection of the op amp $U_2$.

As further illustrated in FIG. 3, the input signal to be integrated $V_{i(t)}$ is applied to an input signal terminal 28 that is coupled to the input gate switch $S_1$ through the buffer amplifier 22. The input buffer amplifier 22 performs four primary functions. First, it buffers the input signal $V_{i(t)}$ and provides a low output impedance to the input of the integrator 24. Second, it inverts the polarity of the input signal $V_{i(t)}$ so that the final output of the gated integrator 20 has the same polarity as the input signal. Third, the buffer can serve as a preamplifier to provide gain if desired. Most importantly, however, the input and feedback resistors $R_1'$, $R_2'$ and $R_{on}$ are selected and adjusted so that the "on" resistances of the input gate switches, $S_1$ and $S_2$ are effectively canceled in the overall circuit transfer function. Preferably, $R_1$, $R_2$, $R_1'$ and $R_2'$ are substantially equal and $R_{on}$ is selected so as to provide sufficient gain to overcome the "on" resistance of the gate switches $S_1$ and $S_2$. If greater than unity gain is desired, the resistance $R'_2$ and $R_{on}$ can be proportionally increased by the desired gain factor.

The output of the buffer 22 is also coupled to the DC offset detector 26 through a fifth switch $S_5$ that in turn controls the input to the DC offset detector 26. The DC offset detector 26 is configured for unitary gain and effectively serves as a sample and hold circuit. When the switch $S_5$ is closed and the circuit 26 is in a sample mode, the capacitor $C_s$ connected between the non-inverting input of the op amp $U_3$ and circuit ground is charged to a voltage substantially equal to the signal baseline offset voltage $V_{bo}$ plus whatever output offset voltage $V_{os}$ is introduced by the buffer amplifier $U_1$. The output of the DC offset detector substantially equals the voltage across the sampling capacitor $C_s$. When the switch $S_5$ opens, the DC offset detector 26 holds the voltage existing across the sampling capacitor $C_s$ at that instant, and this voltage $V_{osi}$ appears at the output of the DC offset detector 26.

In practice, the switches $S_1$ through $S_5$ comprise electronic switches, and suitable control circuitry is employed to open and close the switches as needed to begin and terminate an integrating period and thereafter reset the integrator 20 when desired. In operation, the control signal applied to the DC offset detector sample switch $S_5$ is the complement of that used to control the integrator gate switches $S_1$ and $S_2$. Thus, when switches $S_1$ and $S_2$ are open, switch $S_5$ is closed and vice versa (FIG. 4). This results in the DC offset detector 26 being placed in a hold mode whenever the integrator 20 is placed in an integrating mode. The DC baseline offset appearing in the output $V_{b(t)}$ of the buffer amplifier 22 appears substantially identically in both input channels of the integrator op amp $U_2$ and is effectively canceled by the common mode rejection of the integrator op amp $U_2$. In this manner, errors introduced by reason of the DC offset are effectively nullified. At the same time, and as previously noted, any additional inaccuracies resulting from the active and passive components of the integrator section 24 are effectively canceled by the symmetrical nature and architecture of the integrator section 24.

Figure 5:
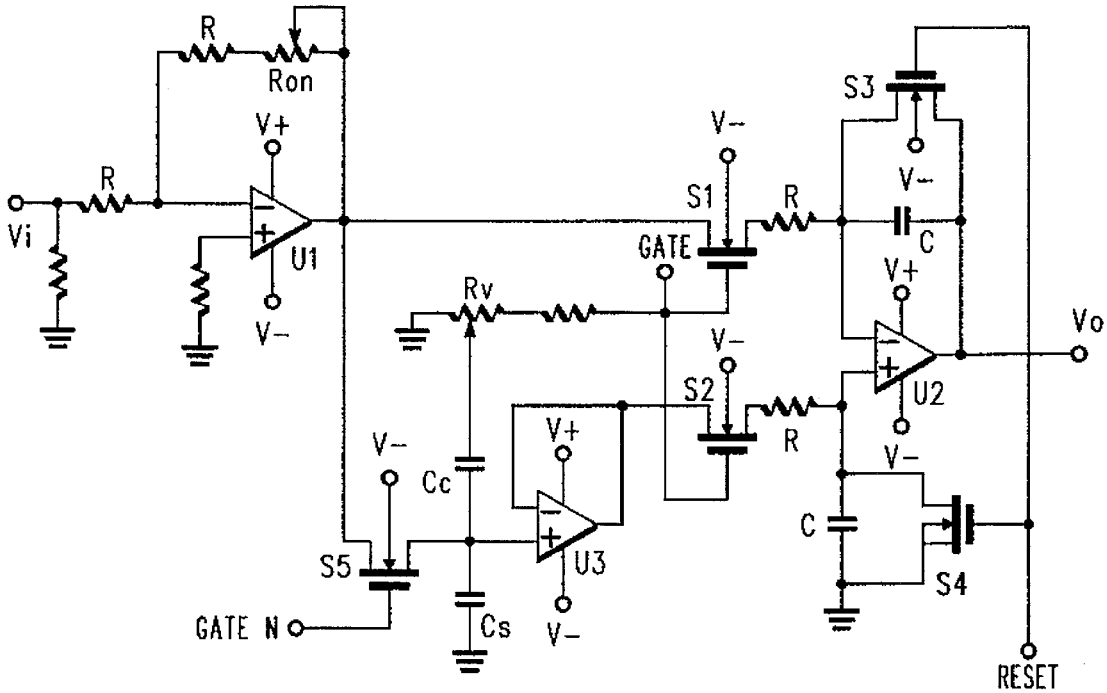
FIG. 5 is a schematic diagram of one actual embodiment of an ultrafast, high precision gated integrator embodying various features of the invention.

A practical ultrafast, high precision gated integrator 20 is shown in schematic form in FIG. 5. This circuit substantially follows the circuit structure shown in simplified form in FIG. 3.

In the input buffer stage 22, the resistor $R_{on}$ is adjustable. This allows the gain of the buffer stage 22 to be adjusted as necessary to cancel the "on" resistance of the input gate $S_1$.

Each of these switches $S_1$–$S_5$ comprises an electronic switch in the form of a n-channel MOSFET. The gate switches $S_1$ and $S_2$ are controlled by means of a positive going gate input control signal while the DC offset sample switch $S_5$ is controlled by the complement of the gate control signal. The output offset can be adjusted to "zero" by means of a variable resistance $R_v$ and series capacitor $C_c$ that couples some of the gate control signal voltage to the non-inverting input of the DC offset detector 26. This adjustment also cancels the charge injection of switch $S_5$. The reset switches $S_3$ and $S_4$ are jointly controlled by a separately applied reset signal.

Preferably, the electronic switches $S_1$–$S_4$ are matched components to ensure system symmetry. The integrating capacitors are similarly matched as are the input resistors $R_1$ and $R_2$.

The gated integrator circuit 20 herein shown and described offers numerous advantages. By compensating for induced error signals, substantially only the real, significant portion of the input signal gets integrated. Furthermore, the input signal baseline offset subtraction is performed by only one gated integrator in one timing window instead of by two gated integrators in two timing windows as in earlier designs. Furthermore, the symmetrical architecture also helps to minimize the errors caused by the op amp input bias current by making the error accumulation rate proportional to the op amp input offset current rather than the input bias current. Hence, drift is significantly reduced. The error can be further reduced by balancing the two integrating capacitors $C_1$ and $C_2$. Because the input offset current is much lower than the input bias current even for very high speed op amps, the error introduced by the input bias current is practically negligible. The symmetrical architecture also results in extremely low output droop rate, since all discharging paths for the integrating capacitors, except very low offset and leakage currents, are cut off when the integrator is in the hold mode. For most applications, the output droop before the completion of analog-to-digital conversion is virtually nonexistent. The cancellation of bias current related drift and very low output droop rate make many high speed op amps suitable for integrator use and also allow the use of a small value capacitor for the integrator capacitor C, which directly results in high gain and speed. It will be appreciated that modifications can be made. For example, if the signal repetition rate is low, a low-pass filter can be successfully used to replace the sample and hold circuit of the DC offset detector shown and described to reduce noise and minimize the effects of timing misalignments.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A gated integrator comprising:

an input buffer amplifier having an input for receiving a signal to be integrated and having an output at which the signal to be integrated appears, said input buffer amplifier further including an input resistor coupled to a buffer op amp with a first and second feedback resistor together being in parallel with the buffer op amp;

a baseline offset detector coupled to said output of said input buffer amplifier and operable to develop a signal equal to a baseline offset of the signal appearing at said output of said input buffer amplifier;

a second op amp having a pair of differential inputs and an output;

a first switched input network coupling said output of said input buffer amplifier through a first resistance element and through a first switch with a first on resistance to one of said differential inputs of said second op amp;

a second switched input network coupling the output of said detector through a second resistance element and a second switch with a second on resistance to the other of said differential inputs of said op amp the resistance of said input resistor, said first feedback resistor, said first resistance element and said second resistance element are substantially equal such that said on resistances of said first and second switch are effectively cancelled;

an integrating capacitor connected between said output of said second op amp and said one of said differential inputs; and an additional capacitor connected between said other of said differential inputs and circuit ground.

2. A gated integrator as defined in claim 1 wherein said first switched input network and said second switched input network comprise matched gate switches.

3. A gated integrator as defined in claim 2 wherein said first input network includes a resistor and electronic switch connected in series between the output of the input buffer amplifier and one of the inputs of the second op amp.

4. A gated integrator as defined in claim 3 wherein said resistors of said first and second input networks are matched components and wherein said electronic switches of said first and second input networks are matched components.

5. A gated integrator as defined in claim 4 wherein said integrating capacitor and said additional capacitor are matched components.

6. A gated integrator as defined in claim 5 wherein said baseline offset detector is coupled to said output of said input buffer amplifier through a third electronic switch.

7. A gated integrator as defined in claim 6 further including control circuitry for simultaneously closing said electronic switches of said first and second input networks while simultaneously opening said electronic switch coupling said DC offset detector to said output of said input buffer amplifier.

8. A gated integrator as defined in claim 7 further including a first reset switch connected across said integrating capacitor and a second reset switch connected across said additional capacitor, said first and second reset switches functioning when closed to reset said gated integrator.

9. A method of configuring a gated integrator to enhance integrating speed and minimize error, said method comprising the steps of:

providing an input buffer amplifier;

providing an opamp having two differential inputs;

coupling an input network to each of said differential inputs wherein each of said input networks comprises matched electrical components so that electronic inaccuracies introduced by each of said input network components occur substantially simultaneously and substantially identically in each of said input networks;

applying a signal to be integrated through the input buffer amplifier and then to one of said differential inputs of said op amp through one of said input networks wherein said signal to be integrated is applied to said one of said differential inputs through a first electronic switch having an associated on resistance, said signal substantially equal to a baseline offset is applied to said other of said differential inputs through a second electronic switch having an associated on resistance and wherein said first and second electronic switches are closed to begin an integrating period and are opened to end said integrating period and further including the step of adjusting gain of said input buffer amplifier to cancel the on resistance of said first and second electronic switches; and applying a signal substantially equal to the baseline offset of the signal to be integrated to the other of said differential inputs through the other of said input networks thereby to balance the baseline offset of the signal to be integrated and thereby render the integrator insensitive to the baseline offset of the signal to be integrated.

10. A method as defined in claim 9 wherein said step of applying a signal substantially equal to the baseline offset of the signal to be integrated is performed by means of a sample and hold circuit.

11. A gated integrator comprising:

an input buffer amplifier having a first op amp and gain resistors including an adjustable resistor;

a second op amp having a non-inverting input, an inverting input and an output;

a first integrating capacitor connected between said output and said inverting input of said second op amp;

a second integrating capacitor connected between said non-inverting input of said op amp and circuit ground;

a first resistor having a first end connected to said inverting input of said op amp;

a first electronic switch having one terminal connected to a second end of said first resistor and said first switch having a characteristic on resistance;

a second resistor having a first end connected to said non-inverting input of said op amp;

a second electronic switch having a first terminal connected to a second end of said second resistor and said second switch having a characteristic on resistance;

said adjustable resistor of said buffer amplifier adjusted in resistance to be the same as said on resistances of said first and second electronic switches;

an input signal terminal for receiving a signal to be integrated, said input signal terminal being coupled to the second terminal of said first electronic switch;

a baseline offset detector having an output connected to the second terminal of said second electronic switch and having an input;

a third electronic switch having a first terminal connected to said input of said baseline offset detector and having a second terminal coupled to said input signal terminal; and control circuitry for simultaneously closing said first and second electronic switches while simultaneously opening said third electronic switch to place said op amp in an integrating mode wherein common mode error components are substantially cancelled and wherein a baseline offset of the signal to be integrated is automatically compensated.

12. A gated integrator as defined in claim 11 wherein said first and second integrating capacitors comprise matched components.

13. A gated integrator as defined in claim 12 wherein said first and second resistors comprise matched components.

14. A gated integrator as defined in claim 13 wherein said first and second electronic switches comprise matched components.

15. A gated integrator as defined in claim 14 further comprising a fourth electronic switch connected across said first integrating capacitor, a fifth electronic switch connected across said second integrated capacitor and control circuitry for simultaneously closing said fourth and fifth electronic switches to reset said gated integrator.

16. A gated integrator as defined in claim 15 wherein said input signal terminal is coupled to said remaining terminal of said first electronic switch through said input buffer amplifier.

17. A gated integrator as defined in claim 16 wherein said input signal terminal is coupled to said input of said baseline offset detector through said input buffer amplifier.

* * * * *